United States Patent [19]

Boda et al.

[11] Patent Number: 4,860,703

[45] Date of Patent: Aug. 29, 1989

[54] COWL ASSEMBLY WITH WATER RESISTANT AIR INTAKE DUCT AND SEALING

[75] Inventors: James C. Boda, Winneconne; Gordon C. Slattery, Omro, both of Wis.

[73] Assignee: Brunswick Corporation, Skokie, Ill.

[21] Appl. No.: 280,687

[22] Filed: Dec. 6, 1988

Related U.S. Application Data

[62] Division of Ser. No. 77,689, Jul. 24, 1987, Pat. No. 4,800,854.

[51] Int. Cl.[4] ..... F02F 7/00

[52] U.S. Cl. ..... 123/195 P; 123/198 E; 440/77; 440/88

[58] Field of Search ..... 123/195 P, 198 E; 440/77, 88

[56] References Cited

U.S. PATENT DOCUMENTS

| | | | |
|---|---|---|---|
| 4,403,971 | 9/1983 | Kobayashi | 440/88 |
| 4,571,193 | 2/1986 | Takada et al. | 440/77 |
| 4,734,070 | 3/1988 | Mondek | 440/88 |

FOREIGN PATENT DOCUMENTS

| | | | |
|---|---|---|---|
| 99893 | 8/1981 | Japan | 440/77 |
| 120598 | 7/1984 | Japan | 440/88 |

*Primary Examiner*—E. Rollins Cross

*Attorney, Agent, or Firm*—Andrus, Sceales, Starke & Sawall

[57] ABSTRACT

An outboard marine motor housed by a cowl assembly having an upper cowl section and a lower cowl section includes various features for improving the structural integrity of the cowl assembly and for providing a water-resistant seal at the joint between the cowl sections and at various points of entry of cables and other mechanical devices. An improved air intake duct prevents the entry of water into the interior cavity of the cowl assembly. The air intake duct is disposed in an air intake opening provided in the top rear portion of the upper cowl section. The air intake duct includes a bottom wall, a pair of upstanding side walls connected thereto, and an upstanding back wall extending between the side walls. The top wall has an upwardly facing opening which forms an air inlet for allowing air to pass into the interior of the cowl assembly, to provide combustion air for the engine of the outboard motor. The air intake duct provides an air flow path whereby air flows forwardly toward the back wall and is then deflected upward to pass through the air inlet in the top wall. Any moisture contained within the air is trapped and prevented from entering the cavity due to the upward deflection of the air.

13 Claims, 6 Drawing Sheets

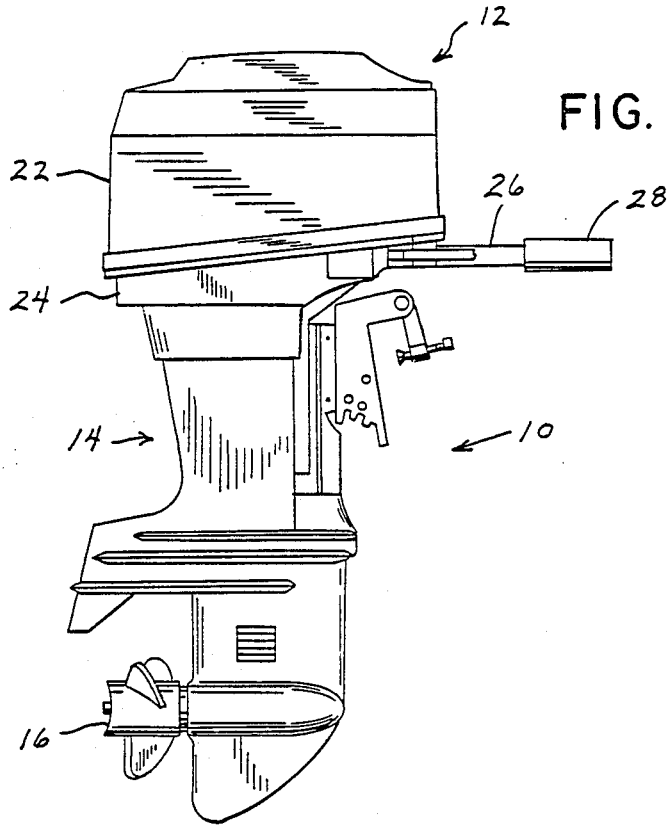
FIG. 1
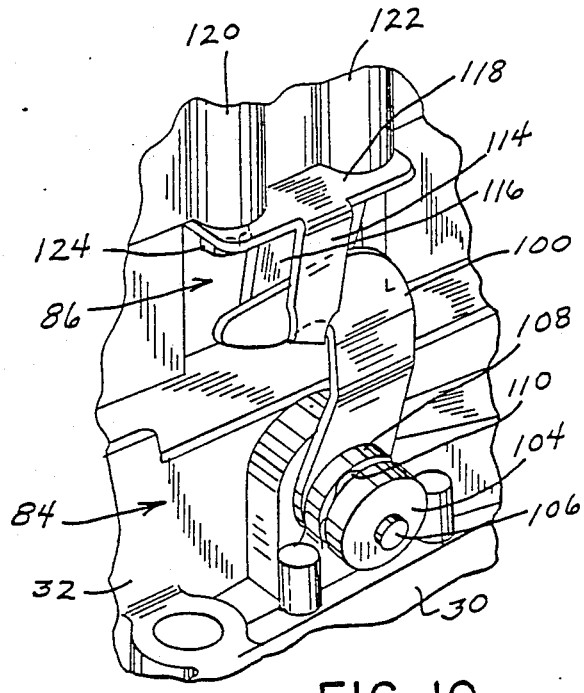
FIG. 10
FIG. 12
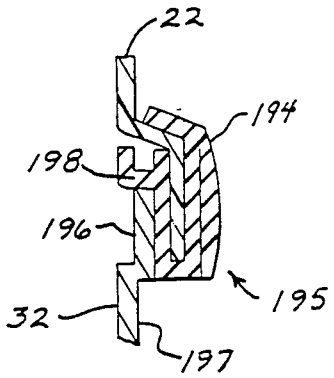

COWL ASSEMBLY WITH WATER RESISTANT AIR INTAKE DUCT AND SEALING

This is a division of application Ser. No. 07/077,689 filed July 24,1987 now U.S. Pat. No. 4,800,854.

BACKGROUND OF THE INVENTION

The present invention relates to outboard marine motors, and more particularly to a cowl assembly for housing the engine portion of an outboard marine motor.

An outboard marine motor generally includes an engine portion and a depending gear case. The engine portion of the outboard motor is typically housed by a cowl assembly. In some outboard motors, the cowl assembly includes an upper cowl section adapted to fit together with a lower cowl section to house the engine portion of the motor. While this configuration is generally desirable and effective for certain sizes of outboard motors, there have been drawbacks to such a construction from the standpoint of resistance to entry of water into the cowl assembly. Certain other features of prior cowl assemblies of this type are undesirable, including the latch mechanism and the lower skirt which depends from the lower cowl section at the upper end of the gear case.

SUMMARY OF THE INVENTION

The present invention incorporates several improvements in a cowl assembly having an upper cowl section and a lower cowl section for housing the engine portion of an outboard marine motor. In combination, the improvements herein disclosed provide a more rigid and water-resistant cowl assembly for an outboard motor, and also facilitate the easy servicing of the outboard motor.

According to one aspect of the present invention, a cowl assembly, including an upper cowl section adapted to fit together with a lower cowl section to house the engine of an outboard motor, is provided with an opening for allowing one or more cables to pass into the interior of the cowl assembly. The opening is provided with sealing means interconnected with the cowl assembly for providing a water resistant seal around the cable at its point of entry into the interior of the cowl assembly. More particularly, the opening is formed by a cut-out portion in the upstanding side wall of the lower pan comprising the lower cowl section. The sealing means is an insert adapted to fit within the cut-out portion in the upstanding side wall of the lower pan. The insert includes cable surrounding means for providing a water resistant sea; at the point of entry of the cable into the interior of the cowl assembly. In one embodiment, the cut-out portion forms a bottom cable passage in the bottom of the lower pan section for allowing a cable to enter the interior of the cowl assembly in a direction substantially parallel to the front-rear longitudinal axis of the cowl assembly. The insert is provided with an inverted channel adapted for placement on the bottom of the lower pan section for surrounding the cable at the bottom cable passage. In another embodiment, a shift lever extends through the cut-out portion in the upstanding side wall of the lower cowl section, and is disposed at its point of entry into the interior of the cowl assembly so as to be substantially perpendicular to the front-rear longitudinal axis of the cowl assembly. The insert is provided with an opening and a flexible grommet for placement within the opening to surround the shift lever at its point of entry to provide a water-resistant seal. In yet another embodiment, a cable is adapted to enter the interior of the cowl assembly through the cut-out portion in the upstanding side wall of the lower cowl section, and is disposed at its point of entry so as to be substantially parallel to the front-rear longitudinal axis of the cowl assembly. A resilient plug is provided to surround the cable at its point of entry, and is adapted to mate with the insert to provide a waterresistant seal at the point of entry.

In accordance with another aspect of the invention, a rotary latch means is provided to secure the upper and lower cowl sections together. The rotary latch means includes a rotatable external handle connected to a shaft extending through the lower cowl section and provided with an internal hook rotatable in response to rotation of the external handle. The shaft extends beyond the hook in the interior of the cowl assembly, and is supported by a support means for preventing lateral movement of the shaft. In one embodiment, the support means comprises an upstanding bearing formed integrally with the lower cowl section and adapted to receive the distal end of the shaft. The hook is engageable with a catch disposed on the upper cowl section. The catch includes a hook engaging portion having a support means disposed on either side of the hook when the hook is engaged with the hook engaging portion of the catch. The catch is supported adjacent an end wall of the upper cowl section, and is also supported at a point spaced from the end wall of the upper cowl section, and the hook engaging portion of the catch means is disposed between the support points.

In accordance with yet another aspect of the invention, an improved air intake duct provides a water-resistant feature for preventing entry of water through the air intake opening which provides combustion air to the engine portion of the outboard motor. The air intake duct also allows air to pass over the portion of the engine which is heated during operation, to pre-heat the combustion air. The air intake duct is adapted for placement in an air intake opening provided in the top rear portion of the upper cowl section. The air intake duct includes a bottom wall, a pair of upstanding side walls connected to the bottom wall, an upstanding back wall extending between the side walls and connected to the bottom wall, and a top wall. The top wall is provided with an upwardly facing opening forming an air inlet, to define an air flow path in which air enters the air intake duct at the air intake opening in the top rear portion of the upper cowl section, and flows in a forward direction toward the back wall of the air intake duct. The air is then deflected upward by the back wall and passes through the opening in the top wall, thereafter entering the interior cavity of the cowl assembly. In this manner, any moisture contained within the air is prevented from entering the interior of the cowl assembly by the upstanding back wall of the intake duct. Furthermore, positioning of the air intake opening at the rear top portion of the cowl section allows air to pass over the engine portion prior to its entry into the combustion chamber through the carburetor. This pre-heating of the combustion air prevents icing of the carburetor in cold conditions. Additionally, the air intake duct provides a convenient hand grip for manually manipulating the motor when necessary.

In accordance with yet another aspect of the invention, a one-piece lower skirt extends downwardly from the cowl assembly at the upper end of the depending gear case. The one-piece lower skirt includes a pair of spaced sides and a back wall, which define an opening for receiveing the upper end of the depending gear case. The one-piece skirt is provided with a flange for connecting the skirt to the lower cowl portion, and is adapted for easy removal and attachment to facilitate servicing the motor.

In accordance with yet another aspect of the invention, a sealing means provides a water resistant seal at the joint between the upper and lower cowl sections about the entire periphery of the joint. The lower cowl section is provided with an upstanding lip about its periphery, and a resilient abutting strip is disposed about the periphery of the upper cowl section to abut the lip when the upper and lower sections are fit together for forming a water resistant seal at the joint. A portion of the periphery, generally the front end of the cowl assembly, is provided with a face, and the upstanding lip adjacent the face is generally parallel to the upstanding side wall of the lower cowl section forming the face. The resilient abutting strip has an abutting surface to engage this portion of the lip.

BRIEF DESCRIPTION OF THE DRAWINGS

The drawing illustrate the best mode presently contemplated of carrying out the invention.

In the drawings:

FIG. 1 is a side elevation view of an outboard motor showing a cowl assembly including the features of the present invention;

FIG. 10 is a perspective view showing the latch mechanism of the present invention;

FIG. 12 is a detailed sectional view showing the front-end sealing means of the present invention.

DETAILED DESCRIPTION

As shown in FIG. 1, an outboard motor 10 includes an upper engine portion 12 and a lower depending gear case 14. A propeller 16 is provided at the lower end of gear case 14, for propelling a boat through water, as is well known.

Figure 2:
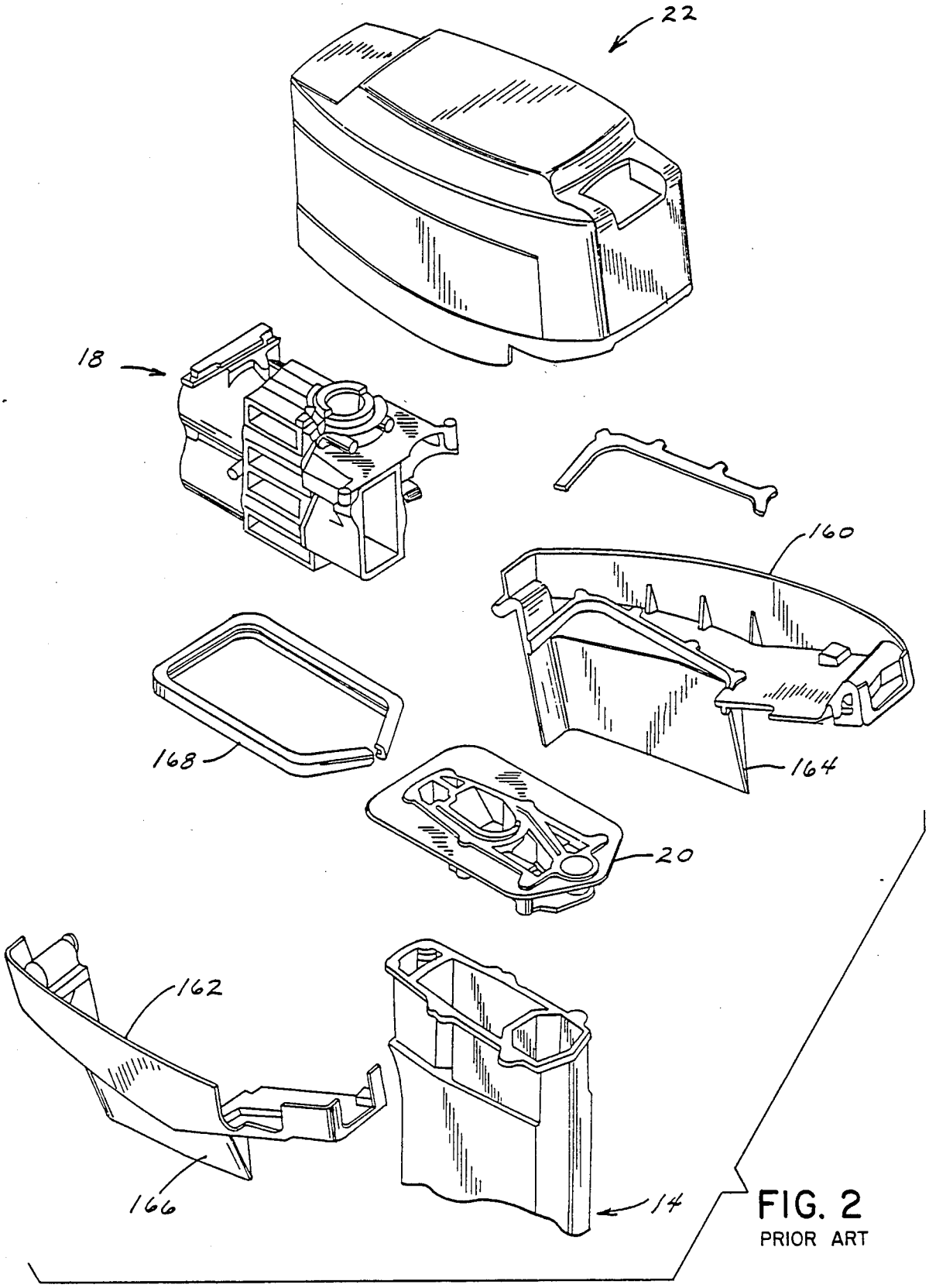
FIG. 2 PRIOR ART
FIG. 2 is an exploded perspective view showing a prior art cowl assembly construction.
Figure 3:
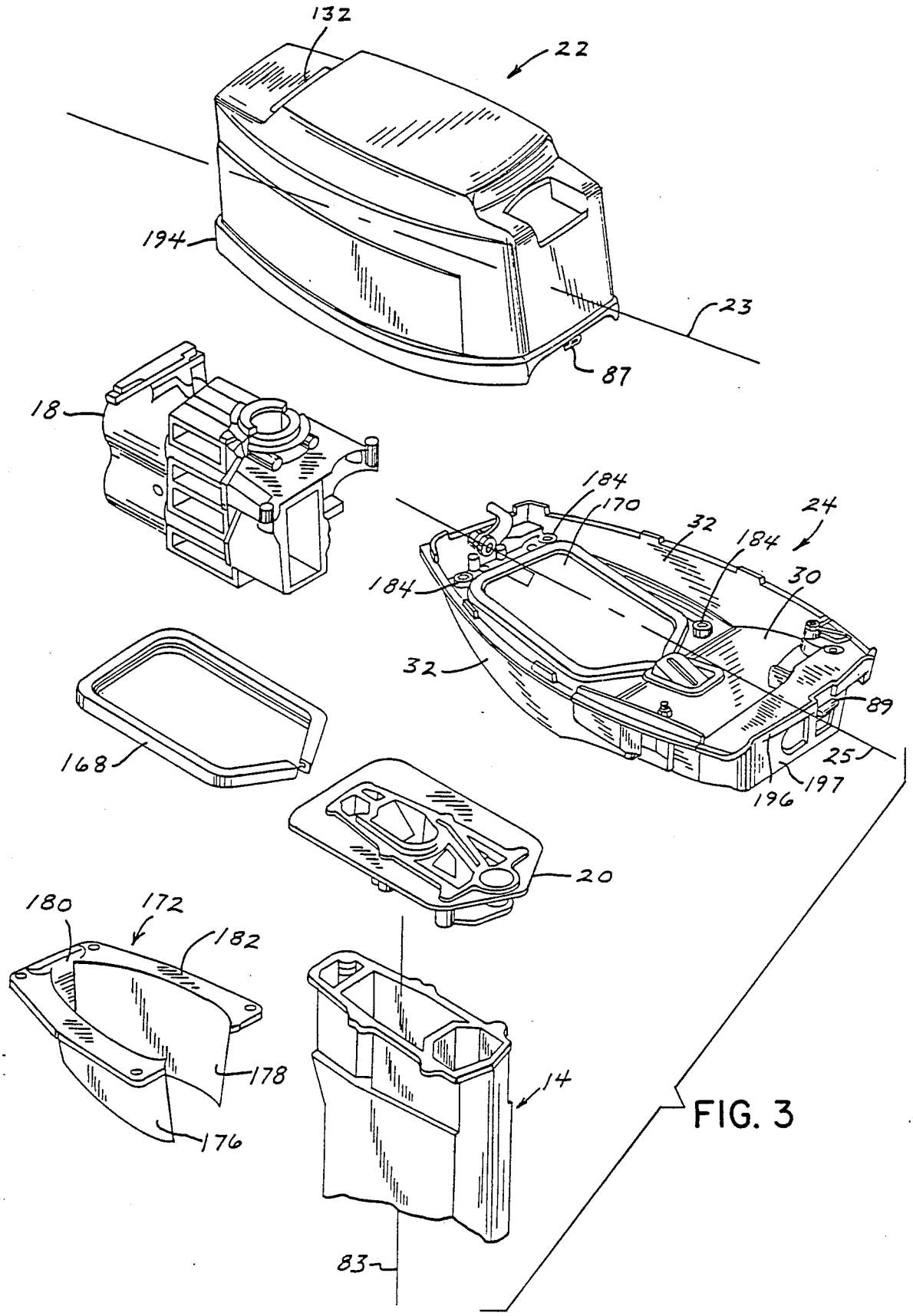
FIG. 3 is an exploded perspective view showing various of the features of the cowl assembly of the present invention.

Referring to FIGS. 1–3, engine portion 12 of outboard motor 10 generally includes an engine 18 adapted for mounting on an adaptor plate 20, which is adapted for mounting to the upper end of gear case 14. An upper cowl section 22 and a lower cowl section 24 house engine 18 of outboard motor 10. Upper and lower cowl sections 22 and 24 extend generally along parallel and coplanar longitudinal front-rear axes 23 and 25, respectively. Lower cowl section 24 is adapted to receive adaptor plate 20, and engine 18 is positioned thereabove so as to be contained within a cavity formed by upper cowl section 22 and lower cowl section 24 when fit together.

Referring to FIG. 1, a tiller arm 26 extends from lower cowl section 24. Tiller arm 26 includes a throttle handle 28 for controlling motor 10, and is also used to control the orientation of motor 12 about a vertical axis, to steer the boat to which motor 10 is attached. In addition, shift controls may also be provided in the tiller arm 26, including forward, neutral and reverse. Tiller arm 26 generally includes a stop control.

Figure 9:
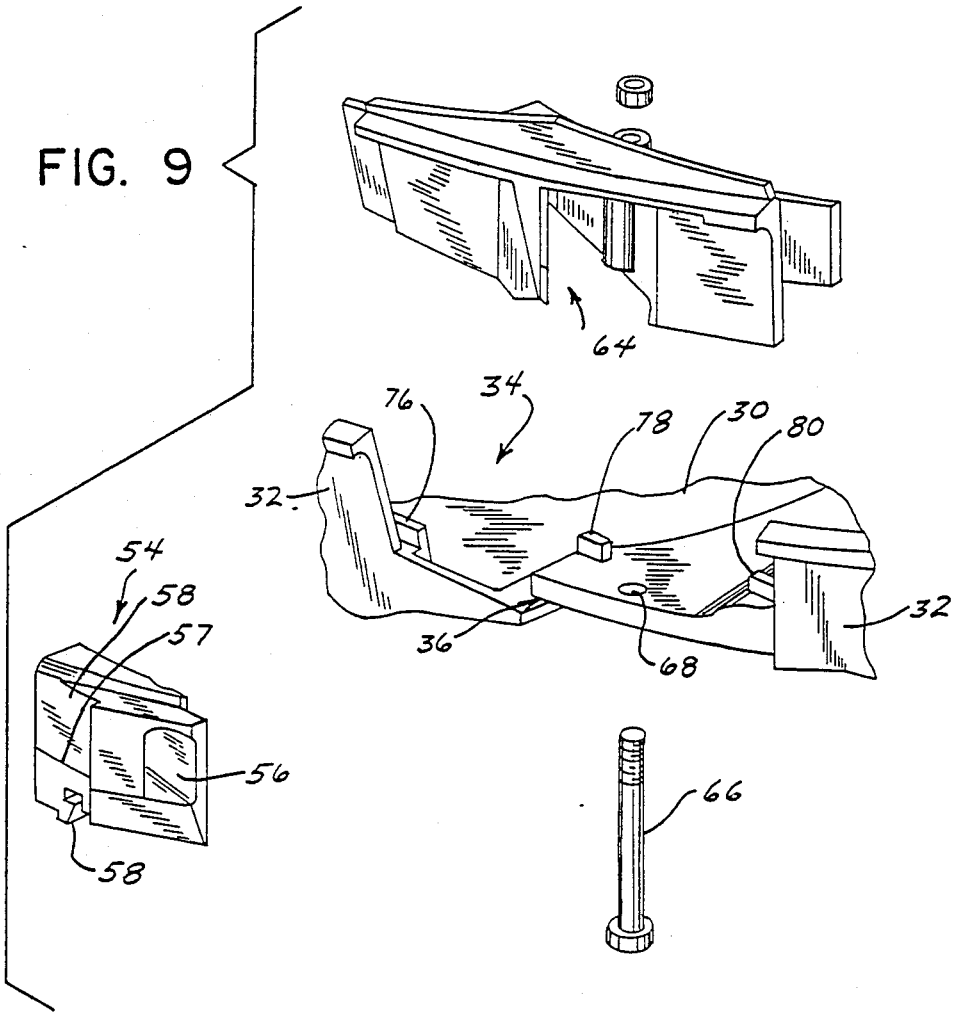
FIG. 9 is an exploded perspective view of the various components of the cable entrance sealing means of FIG. 8.

Lower cowl section 24 is formed of a lower pan having a bottom 30 and an upstanding side wall 32 extending therefrom about the periphery of bottom 30. Upstanding side wall 32 includes a top edge 33. Upstanding side wall 32 is provided with a cut-out portion 34 (FIG. 9), which is adapted to receive cables or other mechanical components for several different engine models and configurations, to allow the same lower cowl section 24 to be used for each of the different models. Referring to FIG. 9, a bottom passage 36 is formed in bottom 30 of lower cowl section 24 and extends inwardly into bottom 30. Bottom passage 36 is generally perpendicular to front-rear axis 25 of lower cowl section 24.

Figure 5:
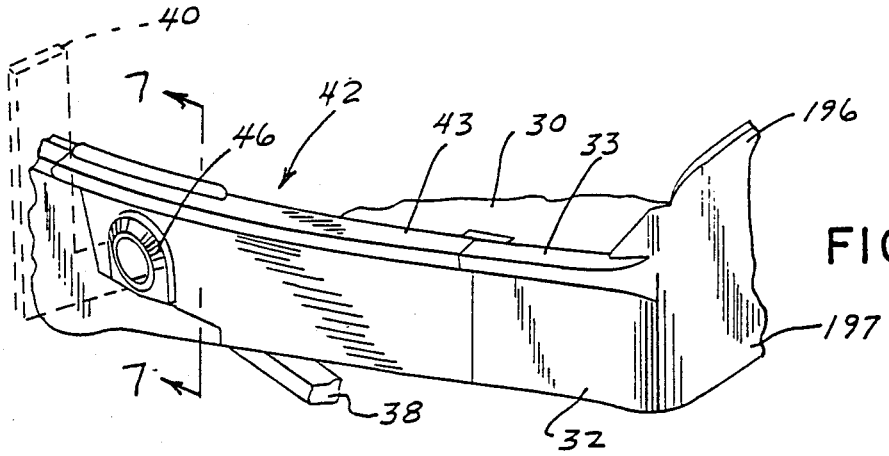
FIG. 5 is a perspective view showing one embodiment of the cable entrance sealing means of the present invention.

With reference to FIG. 5, in an outboard motor configuration having a manual tiller-operated motor with a separate shift lever, a throttle cable 38 is located exteriorly of lower cowl section 24, and is adapted to pass therethrough at bottom passage 36 for entry into the interior of the cowl assembly for connection to internal throttle controls connected to engine 18 (not shown). Throttle cable 38 extends from tiller arm 26 adjacent the point where tiller arm 26 is connected to lower cowl section 24, and is disposed at bottom passage 36 so as to be generally parallel to front-rear axis 25 of lower cowl section 24. A manual shift lever 40 extends through lower cowl section 24 at cut-out portion 34, and is manually operable by the user for shifting the gears of outboard motor 10. The shaft of shift lever 40 is disposed at its point of entry into lower cowl section 24 so as to be substantially perpendicular to front-rear axis 25 of lower cowl section 24.

Figure 7:
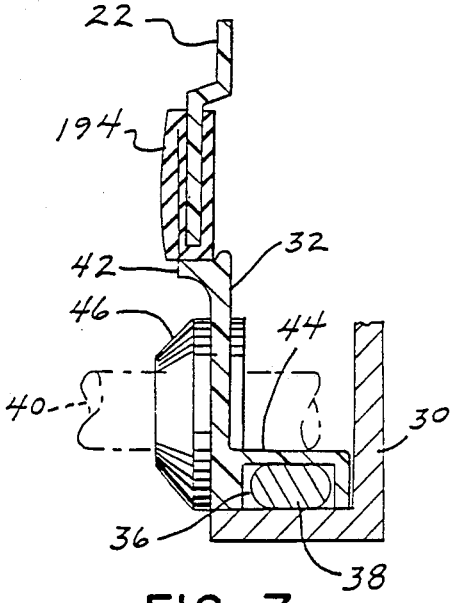
FIG. 7 is a sectional view taken generally along lines 7—7 of FIG. 5.

An insert 42 is adapted for placement within cut-out portion 34 of upstanding side wall 32. Insert 42 fills the void created by cut-out portion 34 in upstanding side wall 30, and is intended to provide a water resistant seal thereat. Insert 42 includes a top edge 43, which is generally aligned with top edge 33 of upstanding side wall 32 at cut-out portion 34. As seen in FIG. 7, insert 42 includes an inverted channel 44, which is adapted for placement on bottom 30 of lower cowl section 24 at bottom passage 36, to define a rectangular cable-receiving passage leading into the interior of the cowl assembly. The cable receiving passage so defined is substantially perpendicular to front-rear axis 25 of lower cowl section 24.

Insert 42 is held in place within cut-out portion 34 by a bolt/nut combination extendind through bottom 30 and engaging a bolt-receiving portion formed on insert 42. When insert 42 is so held, cable 38 is effectively clamped between bottom 30 and the top of inverted channel 44. In this manner, flexing of cable 38 due to engine vibration, shake and torque reactions takes place outside of the cowl assembly, thereby eliminating chafing of cable 38.

Insert 42 also includes an opening in its side for accommodating the shaft of shift lever 40. The opening in insert 42 for shift lever 40 is provided with a circular grommet 46, which is sized so as to fit relatively closely about the shaft of shift lever 40 extending therethrough. In this manner, with the placement of insert 42 within cut-out portion 34 of upstanding side wall 32, and with the provision of inverted channel 44 and grommet 46 therein, a substantially water-resistant seal is provided at the points of entry of throttle cable 38 and the shaft of shift lever 40 into the interior of the cowl assembly.

Figure 6:
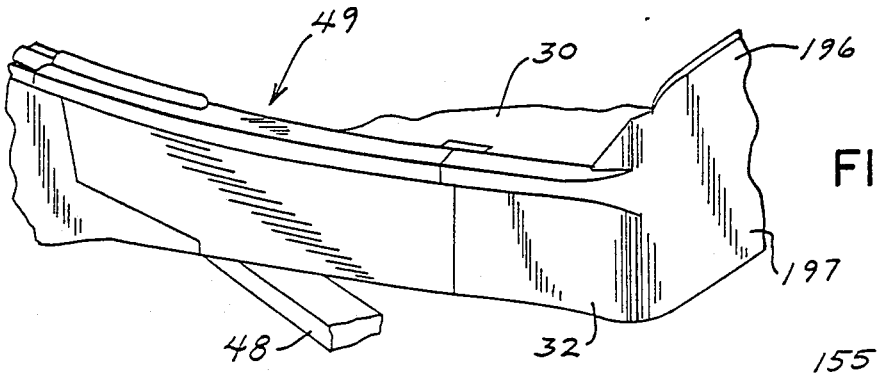
FIG. 6 is a perspective view similar to that of FIG. 5, showing another embodiment thereof.

In another embodiment shown in FIG. 6 involving an outboard motor having manual throttle and shift controls in the tiller arm, a single cable 48 leads from tiller arm 26 and contains and throttle cable and the shift cable. When the shift control is included in a cable such as 48, the shift lever 40 of FIG. 5 is thereby eliminated. In the embodiment of FIG. 6, throttle/shift cable 48 enters into the interior of the cowl assembly through bottom passage 36 provided in bottom 30 of lower cowl section 24. Throttle/shift cable 48 is disposed at its point of entry into the interior of the cowl assembly so as to be substantially parallel to front-rear axis 25 of lower cowl section 24. In this embodiment, an insert 49 serves to close cut-out portion 34 of upstanding side wall 32, and includes an inverted channel such as 44 to accommodate the entry of throttle/shift cable 48 through bottom passage 36 formed in bottom 30 of lower cowl section 24. As in the embodiment of FIG. 5, insert 49 is held in place within cut-out portion 34 by a bolt/nut combination, which serves to clamp cable 48 within opening 36 to eliminate chafing of cable 48 as described above.

Figure 8:
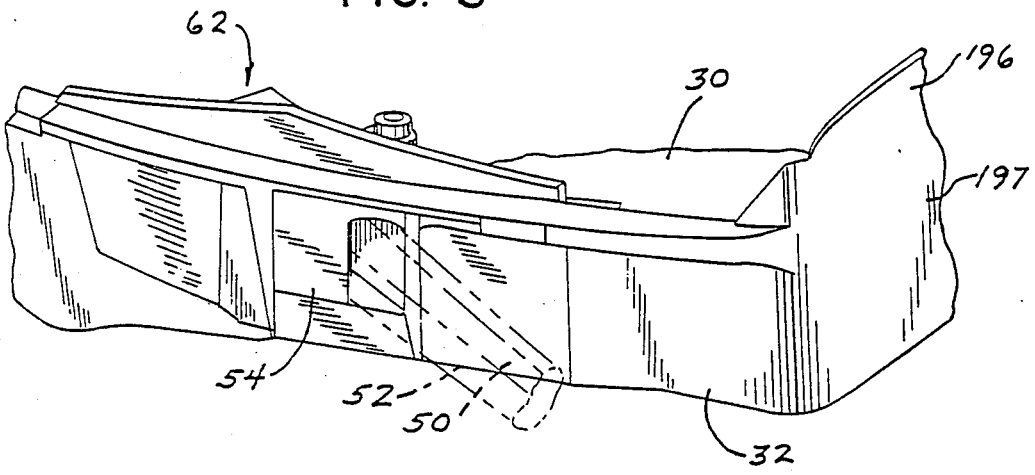
FIG. 8 is a perspective view similar to that of FIGS. 5 and 6, showing another embodiment thereof.

In the embodiment of FIG. 8 involving an outboard motor having remote throttle and shift controls, a throttle cable 50 and a shift cable 52 extend from a remote control (not shown) for outboard motor 10. Throttle cable 50 and shift cable 52 are disposed at their point of entry into the interior of the cowl assembly through cut-out portion 34 so as to be substantially parallel to longitudinal front-rear axis 25 of lower cowl section 24. To accommodate the entry of cables 50 and 52 through cut-out portion 34 of upstanding side wall 32, a resilient plug 54 having an opening 56 extending therethrough is adapted to surround cables 50 and 52. Plug 54 has a slit 57 along its length at the bottom of opening 56. The outer wall 58 of plug 54 is thereby movable to accommodate passage of cables 50 and 52 therethrough into opening 56.

With cables 50 and 52 in a side-by-side relationship, there is no need for any cable to enter into the cowl assembly through bottom passage 36. Therefore, resilient plug 54 is provided with a lower plug portion 58, which is adapted to plug bottom passage 36 in bottom 30 of lower cowl section 24. After cables 50 and 52 have been positiond within opening 56 of resilient plug 54, lower plug 58 is inserted into bottom passage 40.

Referring to FIG. 9, an insert 62 includes a passage 64 for mating with and receiving plug 54. After plug 54 is positioned so as to surround cables 50 and 52 and lower plug portion 58 inserted in bottom passage 36, insert 62 is positioned above cut-out portion 34 and slid downwardly so that passage 64 in insert 62 mates with plug 54, as shown in FIG. 8. This installation of insert 62 provides a water-resistant seal at the point of entry of cables 50 and 52 into the interior of the cowl assembly, and also seals unused bottom passage 36. A bolt 66 is passed through an opening 68 provided in bottom 30 of lower cowl section 24, and also through a passage 70 provided in a lug 72 connected to insert 62. A nut 74 is threaded onto bolt 66 to secure insert 62 within cut-out portion 34 of upstanding side wall 36.

As shown in FIG. 9, a series of upstanding locating tabs 76, 78, 80 are formed on lower cowl section 24 adjacent cut-out portion 34 of upstanding side wall 32 for locating and reinforcing the placement of insert 62 within cut-out portion 34. Tab 76 is formed on the inside of upstanding side wall 32, while tabs 78 and 80 are formed on bottom 30 of lower cowl section 24. Tabs 76–80 prevent lateral movement of insert 62 after it has been secured within cut-out portion 34. Tabs 76–80 also serve the same function in connection with the installation of inserts 42 and 48 within cut-out portion 34 of upstanding side wall 32.

The above three embodiments of the cable entrance sealing means of the present invention all provide for entry of one or more cables into the interior of the cowl assembly so that the cables are disoposed at their point of entry so as to be substantially parallel to front-rear axis 25 of lower cowl section 24. In contrast, prior art systems generally provided for cable entry in a direction substantially perpendicular to the front-rear longitudinal axis of the cowl assembly. Positioning of the cables at their point of entry in accordance with the present invention facilitates the elimination of chafing on the cables due to their movement during operation.

The sealing means of the present invention is also a substantial advance over the art in that a single lower cowl section 24 may be used for several different outboard motor styles and configurations. As above described, the insert for placement within cutout portion 34 of upstanding side wall 32 need only be modified to accommodate the entry of certain cables at certain locations, and also provision of a manual shift lever, if desired.

Figure 4:
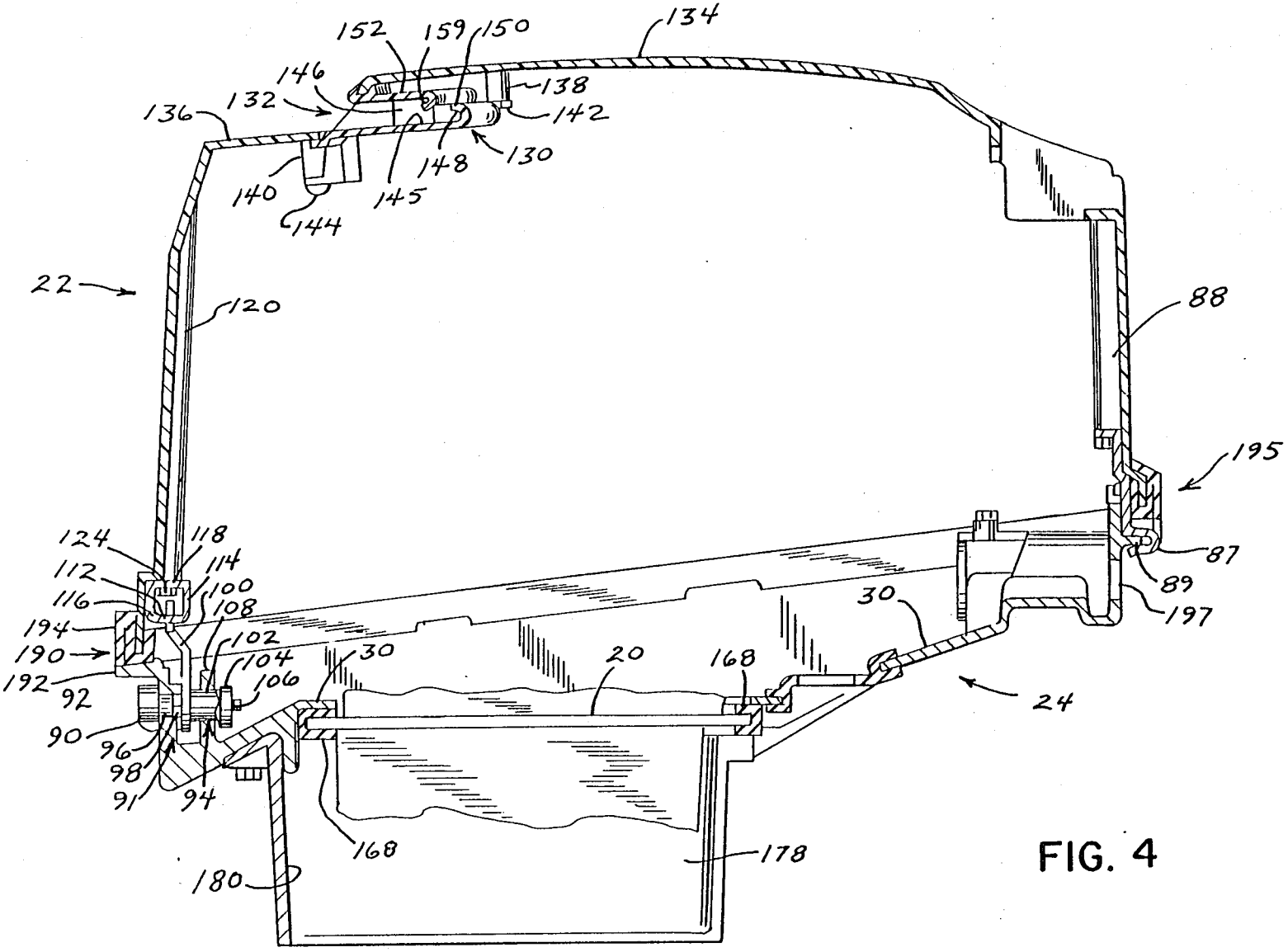
FIG. 4 is a partial longitudinal sectional view of the cowl assembly of the present invention.

Referring not to FIGS. 4 and 10, a latch mechanism 82 disposed on one end wall of upper cowl section 22 includes a rotary latch 84 and a catch mechanism 86. The other end wall of upper cowl section 22 is provided with a depending hook 87, which is bolted at its upper end to a columnar boss 88 formed integrally with the end wall of upper cowl section 22. Hook 87 is engageable with a projecting tongue 89 formed integrally with upstanding side wall 32 of lower cowl section 24. Engagement of hook 87 with tongue 89 secures upper cowl section 22 to lower cowl section 24 at one end, and latch mechanism 82 releasably secures the cowl sections at the other end.

Rotary latch 84 has an external rotatable handle 90 connected to a shaft 91 extending therefrom. Shaft 91 has a proximal end 92 adjacent handle 90, and a distal end 94 spaced therefrom. Shaft 91 extends through and mates with an opening provided in upstanding side wall 32 of lower cowl section 24. Proximal end 92 of shaft 91 is provided with a rounded portion adjacent to and extending from external handle 90 for mating with the opening provided in upstanding side wall 32. A rectangular portion 98 is provided on shaft 91 adjacent to and extending from rounded portion 96. An internal hook 100 is mounted on shaft 91 at rectangular portion 98. Hook 100 is provided with a rectangular opening adapted to mate with and be engaged by rectangular portion 98 of shaft 91, so that hook 100 is rotatable in response to rotation of external handle 90. Distal end 94 of shaft 91 is provided with a rounded portion 102, which has an internal longitudinal passage adapted to receive and mate with rectangular portion 98. An enlarged portion 104 is provided adjacent rounded portion 102.

A screw 106, the end of which is shown in FIG. 10, extends through the components of shaft 91 to hold the various components together in an assembled relation. The head of screw 106 fits within a recess in external handle 90.

As seen in FIG. 4, shaft 91 is supported adjacent its proximal end by the bearing of rounded portion 96 on the internal surface of the opening provided through upstanding side wall 32 of lower cowl section 34. Shaft 91 is also supported adjacent its distal end by an upstanding bearing 108, so that hook 100 is disposed between the points of support of shaft 91. Upstanding bearing 108 is formed integrally with bottom 30 of lower cowl section 24, and has an opening sized so as to mate with rounded portion 102 of shaft 91. Tightening of screw 106 brings enlarged portion 104 of shaft 91 to bear against the side of upstanding support 108, where a wave washer 110 is disposed therebetween to provide smooth turning of rotary latch 84.

Provision of support 108 for shaft 91 at a point beyond hook 100 ensures a secure connection of upper cowl section 22 to lower cowl section 24. Support 108 prevents movement of shaft 91 when outboard motor 10 is subject to jarring, such as that resulting from a collision with an obstacle such as a submerged log during operation. Such support for shaft 91 ensures that hook 100 will remain in place during such jarring.

Hook 100 is engageable with catch mechanism 86, which includes a hook engaging portion 112 extending substantially perpendicular to the end wall of upper cowl section 22. Hook engaging portion 112 is supported at its ends by right support 114 and left support 116, which in turn depend from an upper plate 118. Left support 116 is adjacent the end wall of upper cowl section 22, and right support 114 is spaced therefrom. Hook 100 engages hook engaging portion 112 at a point between right support 114 and left support 116. Upper plate 118 is adapted for connection to a pair of columnar bosses 120, 122 formed integrally with the end wall of upper cowl section 22, by means of a pair of bolts, one of which is shown at 124.

The above-described construction of catch mechanism 86 provides a hook engaging surface which is supported at both ends for receiving the hook of latch mechanism 86 therebetween, thereby eliminating the cantilever of the hook engaging portion from the end wall of upper cowl section 22 normally found in such a catch mechanism. This again ensures a secure attachment of upper cowl section 22 to lower cowl section 24.

Figure 11:
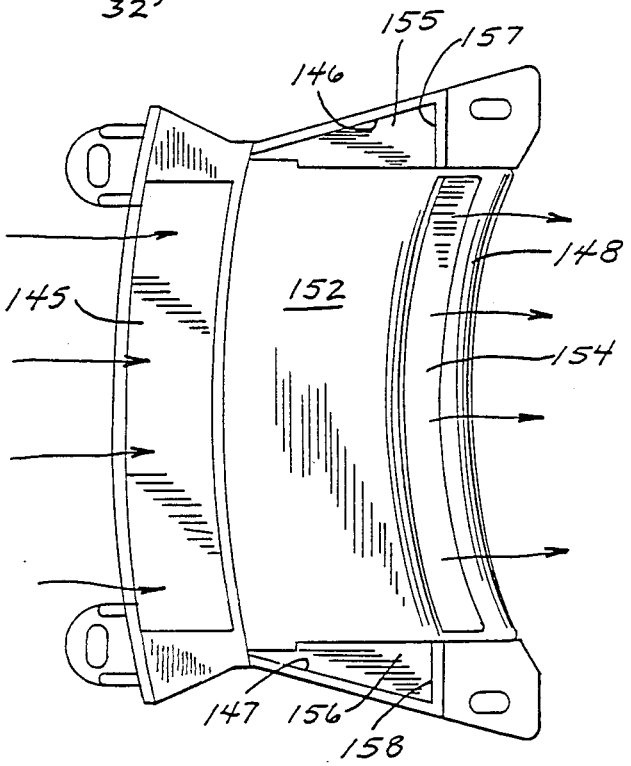
FIG. 11 is a top plan view showing the air intake duct of the present invention.

Referring now to FIG. 4, the present invention includes an air intake duct 130 for placement within an air intake opening 132 formed in the top rear portion of upper cowl section 22. The air intake opening 132 is formed between an upper top wall 134 and a lower top wall 136 of upper cowl section 22. A pair of bosses 138, only one of which is shown, depend from upper top wall 134. Similarly, a pair of bosses 140, only one of which is shown, depend from lower top wall 136. Air intake duct 130 is adapted for placement in the interior of upper cowl section 22 adjacent air intake opening 132, and is connected to upper and lower top wall bosses 138, 140 using screws 142, 144 through openings provided in tabs on air intake duct 130 (FIG. 11).

Air intake duct 130 includes a bottom wall 145 and a pair of spaced upstanding side walls 146, 147 connected thereto. A back wall 148 is connected to bottom wall 145. Back wall 148 is curved to provide an upper lip 150 (FIG. 4), and is also curved in a horizontal plane (FIG. 11).

A top wall 152 extends between side walls 146, 147, and is provided with an upwardly facing opening 154 to form an air inlet for allowing air to pass into the interior of the cowl assembly. As shown in FIG. 11, top wall 152 extends less than the full distance between side walls 146 and 147, to thereby form auxiliary upwardly facing air inlet openings 155, 156 adjacent the top of each side wall for passage of air therethrough into the interior cavity of the cowl assembly. Back wall portions 157, 158 define the back of upwardly facing openings 155, 156, respectively.

As best seen in FIG. 4, the innermost edge of top wall 152 is provided on its underside with a depending curved lip 159. The top of back wall 148 is disposed at an elevation below that of top wall 152, so that the air inlet formed by the termination of top wall 152 is disposed at an elevation lower than that of top wall 152. It should be understood that the invention also contemplates the extension of top wall 148 the full height of side walls 146, 147, so that the air inlet formed by opening 154 is coplanar with top wall 152. It should also be understood that the upwardly facing air inlet openings adjacent the top edges of side walls 146, 147 may also be eliminated by increasing the size of opening 154 and extending top wall 152 the entire distance between side walls 146, 147.

Air intake duct 130 thus defines an air flow path in which air enters intake duct 130 at air intake opening 132 and flows in a forward direction toward back wall 148, and is then deflected upwardly by back wall 148 through opening 154 to enter the interior cavity of the cowl assembly. The upward deflection of the air during its entrance into the interior of the cowl assembly prevents the entrance of any moisture contained within the air into the interior cavity as a result of the change in direction of the air flow provided by the air flow path defined by air intake duct 130. Lips 150, 159 also act to capture and prevent the entrance of any moisture contained within the air into the interior of the cowl assembly.

Furthermore, the placement of air intake opening 132 in the rear top portion of upper cowl section 22 allows for passage of combustion air over the heating portion of the outboard motor engine. Such air flow pre-heats the combustion air prior to its entry to the combustion chamber through the carburetor, to prevent icing of the carburetor in cold weather operating conditions.

The above described construction of air intake duct 130 provides an unobstructed hand grip for use in manually manipulating outboard motor 10. For example, the user's fingers may be inserted into the space between bottom wall 142 and top wall 152 to aid in tilting the motor forward.

Referring to FIG. 4, bottom wall 145 of air intake duct 130 slopes rearwardly away from back wall 148, so that moisture collected within duct 130 from air flowing therethrough may exit duct 130 and drain therefrom via rearwardly-sloping lower top wall 136 of upper cowl section 22.

With reference to FIG. 2, prior outboard motor structures provided an upper cowl section 22 and a two-piece lower cowl section comprising longitudinally split halves 160, 162. Each of longitudinal split halves 160, 162 included a lower depending skirt half 164, 166, respectively. Lower cowl sections 160, 162, when interconnected, are adapted to surround the edge of adapter plate 20. A foam rubber sealing strip 168 is placed about the edge of adapter plate 20, to provide a water resistant seal at the joint between adapter plate 20 and lower cowl halves 160, 162. When lower cowl halves 160, 162 are fit together, depending skirt halves 164, 166 surround the sides and rear of depending gear case 14. Skirt halves 164, 166 are generally formed integrally with lower cowl halves 160, 162.

In the improved construction of FIG. 3, as noted previously, lower cowl section 24 includes a bottom 30 and an upstanding side wall 32 extending therearound. Bottom 30 of lower cowl section 24 is provided with an opening 170 for receiving adaptor plate 20 from the underside of bottom 30.

A one-piece lower skirt 172 includes a pair of depending sides 176, 178 and a rear depending wall 180 extending therebetween. Sides 176, 178 and rear wall 180 define an opening adapted to receive the upper end of depending gear case 14, which is formed accordingly.

Lower skirt 172 includes a flange 182, which is adapted for connection to the underside of bottom 30 of lower cowl section 24. The underside of lower cowl section 24 is provided with a recessed portion adjacent opening 170 for accommodating flange 182 of lower skirt 172. The one-piece construction of skirt 172 allows quick and easy removal and attachment of skirt 172 to facilitate servicing of the motor and the upper portion of gear case 14.

To assemble the lower components of the cowl assembly, sealing strip 168 is again provided about the edge of adaptor plate 20, after which plate 20 is placed against the underside of bottom 30 at opening 170. One-piece lower skirt 172 is placed against the bottom of adaptor plate 20 to sandwich adaptor plate 20 between lower cowl section 24 and skirt 172. One-piece skirt 72 is then attached to the underside of lower cowl section 24 using a series of bolts extending through holes provided at the corners of flange 182 of skirt 172, with mating nuts being provided at nutreceiving pockets 184 in lower cowl section 24. This construction provides highly desirable vibration and noise isolation. After connection of skirt 172 to lower cowl section 24, engine portion 18 is mounted to adapter plate 20 above bottom 30 of lower cowl section 24.

Lower skirt 172 is constructed so that, after assembly, flange 182 lies in a plane substantially transverse to a longitudinal gear case axis 183.

When upper cowl section 22 and lower cowl section 24 are fit together, a peripheral joint is formed therebetween. In previous constructions, the peripheral joint between upper cowl section 22 and lower cowl section 24 was sealed about the sides and rear of the cowl assembly, but the front joint was generally left unsealed. The present invention discloses a structure for sealing the front joint.

As shown in FIG. 4, a rear joint 190 includes a substantially horizontal upper lip 192 disposed at the top of upstanding side wall 32 of lower cowl section 24. Horizontal lip 192 extends across the rear of upstanding side wall 32, and also along the sides of upstanding side wall 32. A rubber molding strip 194 is provided at the lower edge of upper cowl section 22, and has a substantially horizontal lower surface adapted to abut the top of upper lip 192 for providing a water tight seal therebetween. This construction is known in the prior art.

At front joint 195 (FIG. 12) , which in the past has been unsealed, the present invention provides an upstanding lip 196 extending upwardly from a face 197 formed by upstanding side wall 32 of a lower cowl section 24. Lip 196 is disposed in a plane substantially parallel to that of face 197, which may be substantially vertical. As seen in FIGS. 3 and 5–8, each corner of lower cowl section 24 adjacent face 197 is formed so as to provide a smooth transition between horizontal lip 192 on the side portions of upstanding side wall 32 of lower cowl section 24 and vertical lip 196.

Similarly, sealing strip 194 is modified at the front side of upper cowl section 22, so that the plane of sealing between lip 196 and sealing strip 194 is substantially vertical. The inwardly facing portion of sealing strip 194 is provided at its upper end with a horizontal portion 198 for abutting the top of vertical lip 196, to ensure a water-resistant seal thereat.

It is understood that various alternatives and modifications are contemplated as being within the scope of the following claims particularly pointing out and distinctly claiming the subject matter regarded as the inventio.

We claim:

1. In an outboard marine motor including a cowl having an interior cavity for housing the engine of said outboard motor, said cowl including an air intake opening in its rear top portion, a one-piece air intake duct for placement in said air intake opening and for connection to said cowl, comprising:

a bottom wall;

a pair of upstanding side walls connected to said bottom wall;

an upstanding back wall connected to said bottom wall; and a top wall extending between said upstanding side walls and spaced from said bottom wall, said top wall having an upwardly facing opening therein forming an air inlet, said walls defining an air flow path in which air enters said duct at said air intake opening in said rear top portion of said cowl and flows in a forward direction toward said back wall and then flows upwardly through said air inlet in said top wall and enters the interior cavity of said cowl, to thereby prevent the entrance of any moisture contained in said air into said interior cavity due to the change in direction of air flow provided by said air flow path.

2. The intake duct according to claim 1, wherein said top wall extends less than the full distance between said side walls, thereby forming an auxiliary upwardly facing opening adjacent the top of each side wall for allowing passage of air therethrough into said interioir cavity of said cowl.

3. The intake duct according to claim 1, wherein said top wall extends less than the full depth of said air intake duct and terminates at a point spaced from said back wall to form said air inlet.

4. The intake duct according to claim 3, wherein said back wall terminates at a point below said top wall, so that said air inlet is disposed in a plane below the plane of said top wall.

5. The intake duct according to claim 1, wherein said air intake duct, when placed within said air intake opening in said cowl, forms an unobstructed hand grip for use in manually manipulating said motor.

6. The intake duct according to claim 1, wherein said bottom wall of said intake duct slopes rearwardly away from said back wall to allow moisture collected within said duct from air flowing therethrough to exit said duct and drain therefrom.

7. The intake duct according to claim 6, wherein said cowl is configured so as to provide a rearwardly sloping surface adjacent said air intake opening, and wherein said rearwardly sloping bottom wall of said intake duct abuts said rearwardly sloping surface of said cowl to allow said collected moisture to drain from said intake duct onto said rearwardly sloping surface of said cowl.

8. A cowl assembly for enclosing the engine of an outboard motor, comprising:

an upper cowl section;

a lower cowl section;

said upper and lower cowl sections adapted to fit together to form an interior cavity for housing said engine and forming a joint therebetween when placed about said engine;

sealing means for providing a fluid resistant seal along the length of said joint; and air intake means for providing air to said interior cavity through said cowl assembly, said air intake means comprising:

a bottom wall;

a pair of upstanding side wall connected to said bottom wall;

an upstanding back wall connected to said bottom wall; and a top wall extending between said upstanding side walls and spaced from said bottom wall, said top wall having an upwardly facing opening therein forming an air inlet, said walls defining an air flow path in which air enters said duct at said air intake opening in said rear top portion of said cowl and flows in a forward direction toward said back wall and then flows upwardly through said air inlet in said top wall and enters the interior cavity of said cowl, to thereby prevent the entrance of any moisture contained in said air into said interior cavity due to the change in direction of air flow provided by said air flow path.

9. The invention according to claim 8, wherein said sealing means comprises a lip disposed about the periphery of one of said cowl sections and a rsilient abutting strip disposed about the periphery of the other of said cowl sections to abut said lip when said upper and saie lower cowl sections are fit together for forming said fluid resistant seal at said joint.

10. The invention according to claim 9, wherein said lower cowl section comprises a pan having a bottom and an upstanding side wall extending about the periphery of said bottom, and wherein said lip is disposed at the upper end of said upstanding side wall.

11. The invention according to claim 9, wherein said lip is disposed so as to be generally perpendicular to said upstanding side wall, and wherein said resilient abutting strip includes a lip-abutting surface for engaging said lip to provide said fluid resistant seal at said joint.

12. The invention according to claim 11, wherein, at a portion of said periphery of said upstanding side wall of said lower pan, said lip is disposed so as to be substantially parallel to said upstanding side wall, and wherein said resilient abutting strip is provided with an abutting surface to engage said lip where said lip is disposed substantially parallel to said upstanding side wall.

13. The invention according to claim 12, wherein said portion of said seal where said lip is disposed substantially parallel to said upstanding side wall is formed on the outer surface of said upstanding side wall of said pan.

* * * * *